United States Patent [19]

Millen

[11] Patent Number: 4,541,626

[45] Date of Patent: Sep. 17, 1985

[54] SHEET REGISTRATION APPARATUS AND DEVICE

[75] Inventor: Jeffrey A. Millen, Letchworth, England

[73] Assignee: Xerox Corporation, Stamford, Conn.

[21] Appl. No.: 511,034

[22] Filed: Jul. 5, 1983

[30] Foreign Application Priority Data

Jul. 7, 1982 [GB] United Kingdom ..... 8219712

[51] Int. Cl.[4] ..... B65H 9/00

[52] U.S. Cl. ..... 271/236; 271/113; 271/184; 271/250; 271/220

[58] Field of Search ..... 271/113, 250, 251, 207, 271/220, 224, 184, 236, 119; 226/182

[56] References Cited

U.S. PATENT DOCUMENTS

| | | | |
|---|---|---|---|
| 372,389 | 11/1887 | Schneider | 271/113 |
| 2,910,293 | 10/1959 | Kelchner | 271/236 |
| 3,175,824 | 3/1965 | Albosta | 271/52 |
| 3,516,656 | 6/1970 | Sherman | 271/52 |
| 3,556,512 | 1/1971 | Fackler | 271/4 |
| 3,719,266 | 3/1973 | Korn et al. | 198/35 |
| 3,877,804 | 4/1975 | Hoppner | 355/8 |
| 3,907,376 | 9/1975 | Drutchas | 303/21 BB |
| 3,908,986 | 9/1975 | Bleau | 271/227 |
| 3,970,299 | 7/1976 | Berger, Jr. et al. | 271/250 |
| 3,980,296 | 9/1976 | Craft et al. | 271/251 |
| 4,015,843 | 4/1977 | Tennant | 271/240 |
| 4,033,574 | 7/1977 | Stange et al. | 271/3 |
| 4,165,870 | 8/1979 | Fallon | 271/113 X |
| 4,319,743 | 3/1982 | Rood | 271/184 |
| 4,398,709 | 8/1983 | Janssen | 271/113 X |

FOREIGN PATENT DOCUMENTS

| | | | |
|---|---|---|---|
| 2028773 | 3/1980 | United Kingdom | 271/184 |
| 1593369 | 7/1981 | United Kingdom . | |

*Primary Examiner*—Richard A. Schacher
*Attorney, Agent, or Firm*—Bernard A. Chiama

[57] ABSTRACT

A sheet registration apparatus and device for registering a sheet on a surface 72 against a registration stop 75 or 74, 75 includes a wiper device 100 having a plurality of resilient blades 101 rotatable about an axis 103 which is generally normal to the surface 72. The blades lie in radial planes through the axis and extend in the direction of the axis towards sheet-engaging tips 106 which are arranged to wipe across the sheet surface over a limited arc of rotation so as to urge the sheets towards the registration stop. To this end the blades are held out of contact with the sheets during part of each revolution by a swash plate 102 having an arcuate opening 114.

18 Claims, 12 Drawing Figures

Figure 1:
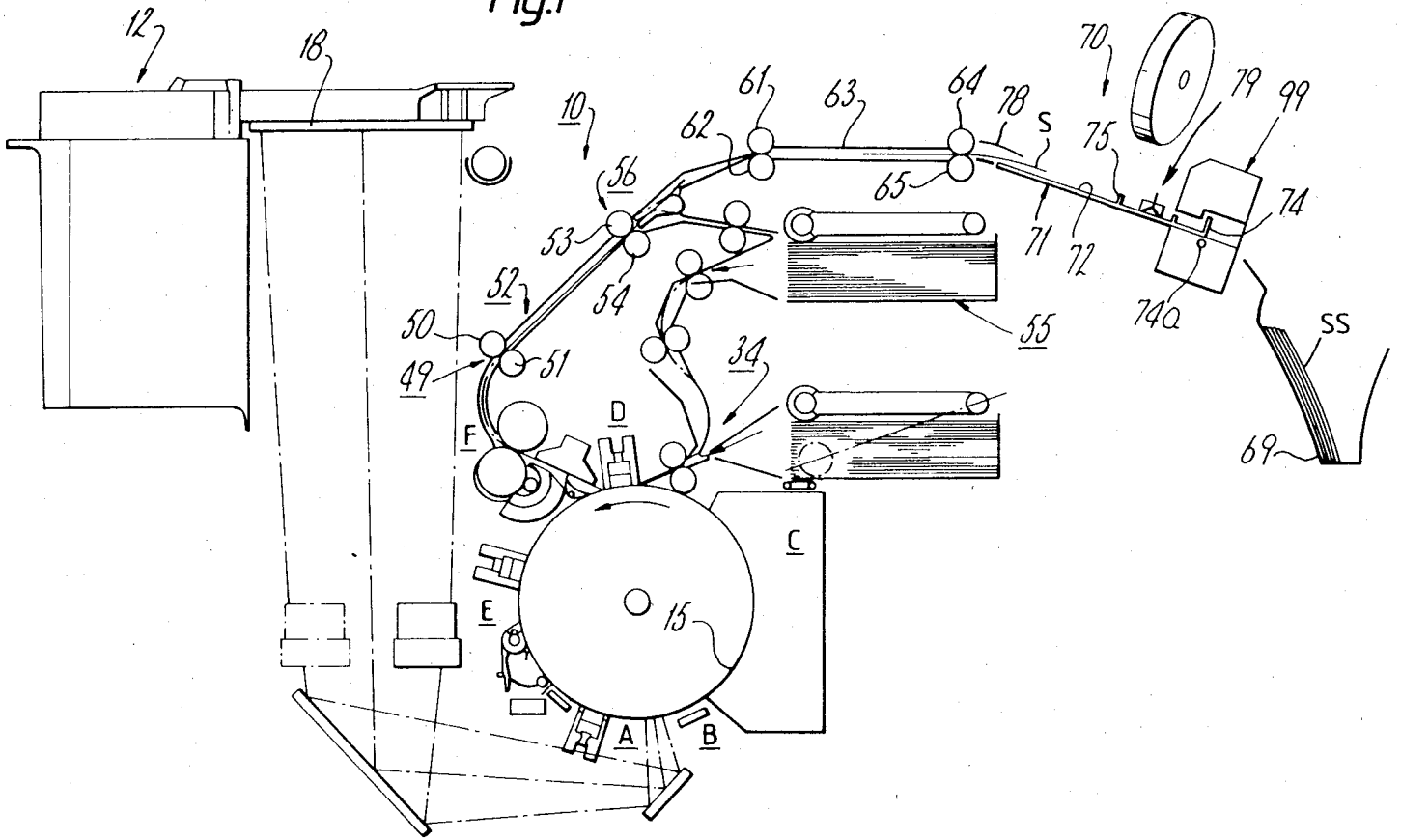

12
18
10
36
53
54
52
51
50
49
F
E
D
A
B
C
15
34
55
61
62
63
64
65
78
S
71
72
75
70
79
99
74
74a
SS
69

SHEET REGISTRATION APPARATUS AND DEVICE

This invention relates to a sheet registration apparatus for registering a sheet on a surface against a registration edge and to a sheet registration device suitable for use in such apparatus.

Sheets may be registered for various purposes. For example sheet registration devices are used in automatic document handlers of photocopiers where a sheet is automatically fed on to the platen of the photocopier for exposure and, following exposure, fed off the platen. Such apparatus may be used to register a document to be copied against a registration edge of the platen. Alternatively, or additionally, in semi-automatic document handlers in which a sheet is manually inserted into the input of the document handler, a registration device may be used to align the document prior to feeding on to the platen, as for example in U.S. Pat. No. 3,877,804. Another application of sheet registration apparatus is when stacking sheets particularly when stacking sheets for binding. It is important when stacking sheets fed serially to a stacking location that the sheets be stacked in registration with each other so as to provide an attractive and compact set or signature with uniform edges. For complete registration the sheets need to be aligned by laterally and longitudionally. This may be achieved both registering two adjacent edges (one end and one side) of the sheet with respect to respective registration stops and this form of registration is termed corner registration. Stacking may be required in addition to compiling the sheets into sets to position the sheets with respect to a fixed finishing device such as a stitcher, stapler or punch. This is readily achieved by corner registration.

Various registration apparatus and devices have been proposed in the past.

In U.S. Pat. No. 4,015,843 newspapers are aligned as they travel along a conveyor by edge rollers. Numerous sheet registration devices employ angled rollers as found for example in U.S. Pat. Nos. 3,516,656, 3,175,824 and 3,980,296. Sheets may also be registered by fluidic means as described for example U.S. Pat. No. 4,033,574.

A particularly advantagous form of sheet registration device is that described for example in U.S. Pat. No. 3,719,266 and generally referred to as a paddle wheel device. The device comprises a hub on which are amounted a plurality of blades made of flexible elastomeric material. The hub is rotated on a shaft inclined at an acute angle to the sheet path with the blades projecting at right-angles to the sheet path to effect a thrust in a sideways direction to sheets moving along the sheet path. In this way the sheets may be readily aligned against a side registration edge and by providing an end registration edge across the path corner registration is achieved.

Another type of registration device is found in U.S. Pat. No. 3,907,376 which describes a device comprising a thin, flexible round disc member mounted to a shaft in such manner that the plane of the disc member is skewed to the shaft rotation, while U.S. Pat. No. 3,908,986 describes a ball on roller sheet alignment device.

In UK Pat. No. 1593369 registration is achieved by an endless belt extending across the bottom of a downwardly inclined sheet support surface, which belt is driven to feed a sheet in contact therewith towards a side registration edge.

Finally, in U.S. Pat. No. 3,970,299 there is disclosed a sheet registration device in the form of a rotating brush arranged to exert a force on a sheet positioned thereunder which moves the sheet towards a side guide. The brush may have the bristles thereof extending either axially or radially.

A sheet registration apparatus according the present invention for registering a sheet on a surface against a registration stop, comprises a device having a plurality of resilient blades lying in radial planes passing through an axis arranged generally normal to the surface and about which said blades are rotatable with said blades extending in the direction of said axis towards said surface and terminating in sheet-engaging tips arranged to wipe generally unidirectionally against a sheet on the surface to urge it towards said registration edge.

In a preferred embodiment the blades are arranged to contact a sheet on the surface over a limited arc of rotation to urge the sheet towards the registration edge by means of a swash plate, arranged beneath the blades and above and generally parallel to the surface, which has an arcuate opening defining the arc of contact. The arcuate extent and angular position of the opening in the swash plate as well as the height of the swash plate above the support surface will depend on a number of factors, including the number of blades the registration device has and its speed of rotation. It has been found that satisfactory results may be achieved using openings of between 90° and 150°. In the latter case the blades should desirably be effectively angled slightly outwardly from the axis of the device. The swash plate is made of sheet steel having the upper surface thereof which is contacted by the blade tips having a coating of a low-friction material, such as fluorocarbon (PTFE) resin.

From another aspect of the invention, a sheet registration device suitable to use in apparatus as described includes a hub having an axis of rotation and a plurality of resilient blades arranged in radial planes passing through said axis and extending in the direction of said axis beyond one end of the hub towards sheet-engaging tips lying in a common plane normal to said axis.

In one embodiment, the blades are attached to the hub at their ends opposite the tips and taper towards the tips which are rounded. The device has four blades arranged symmetrically about the axis with the blades angled outwardly from the axis of rotation a small amount, say 20°.

Figure 2:
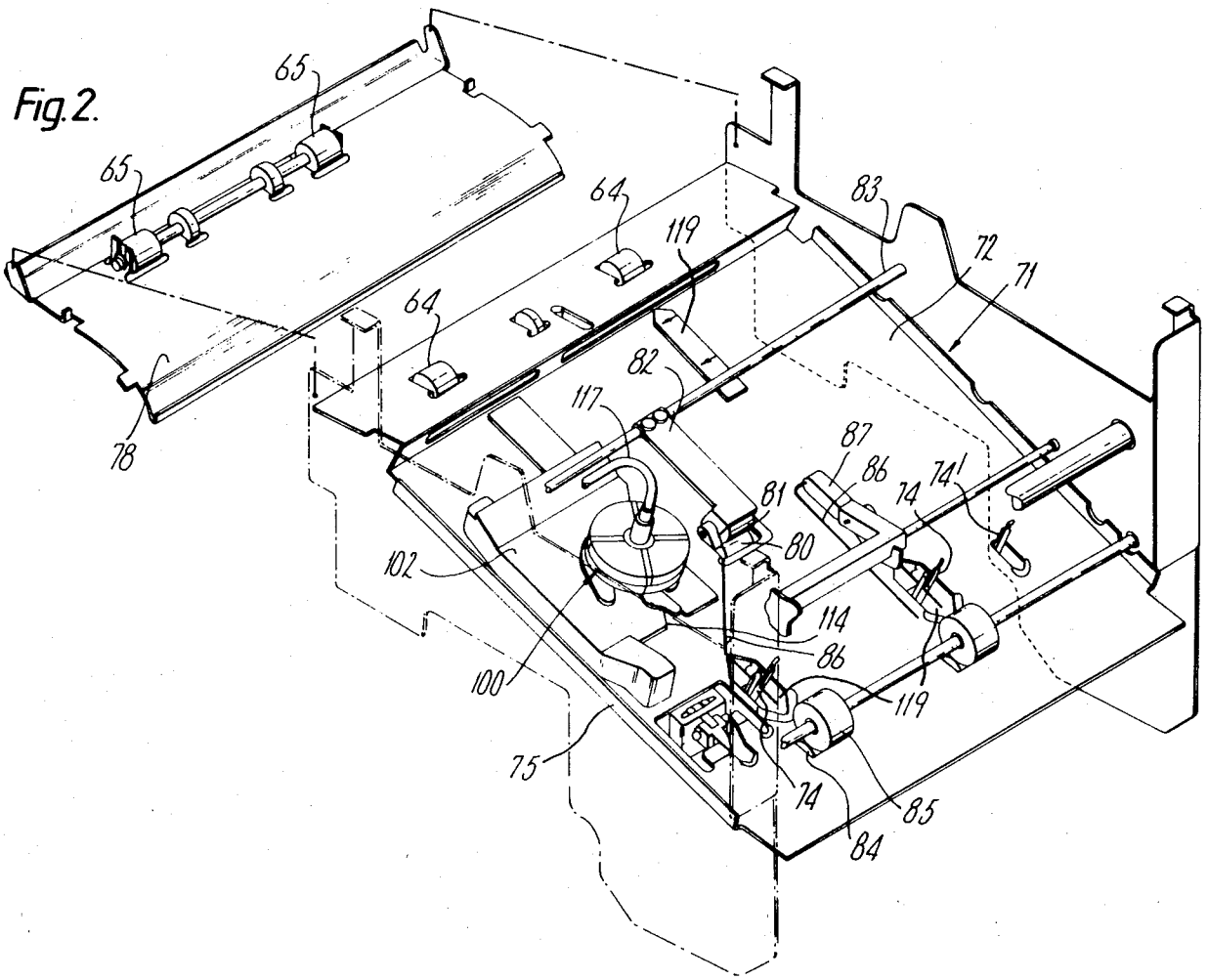
Figure 3:
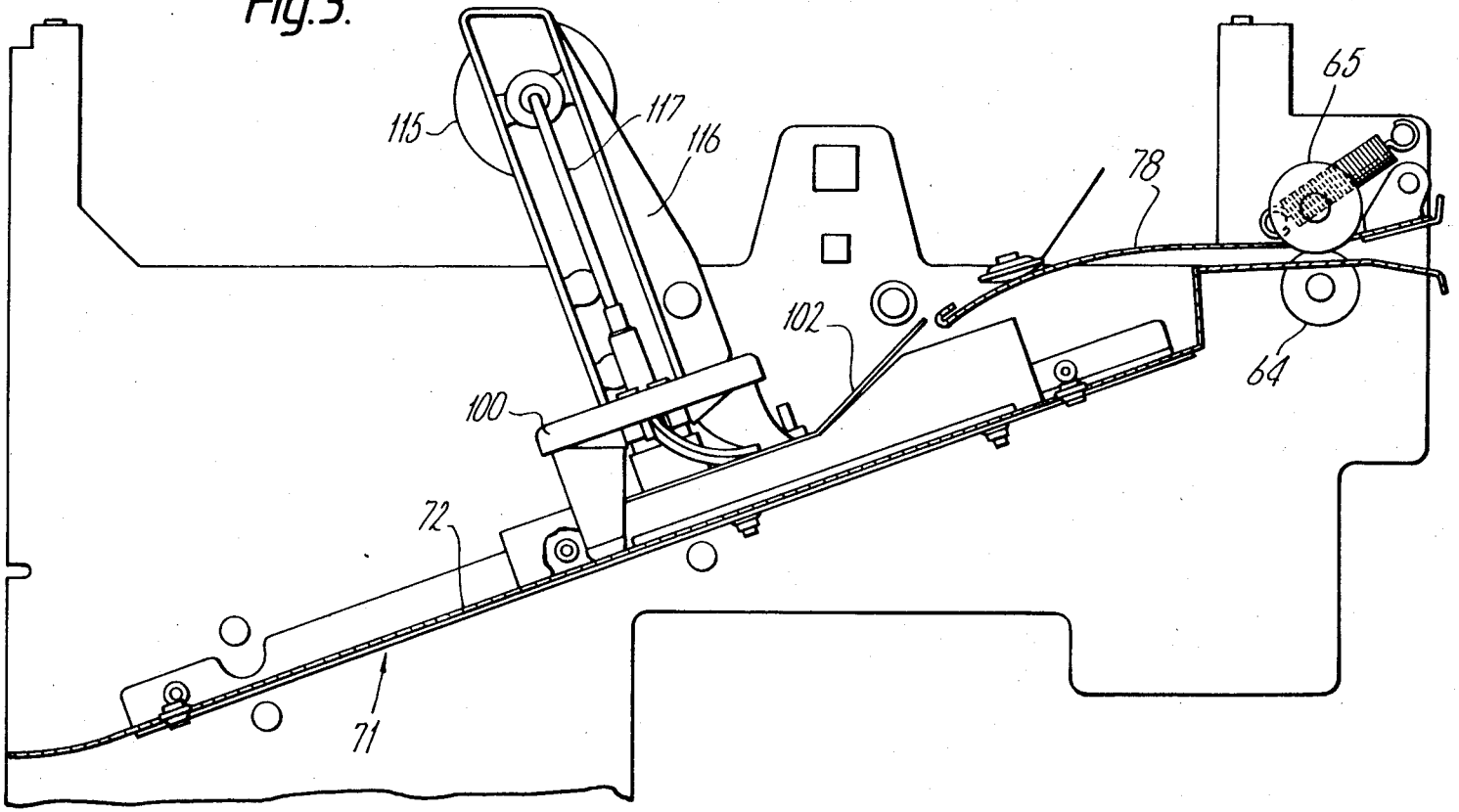
Figure 4:
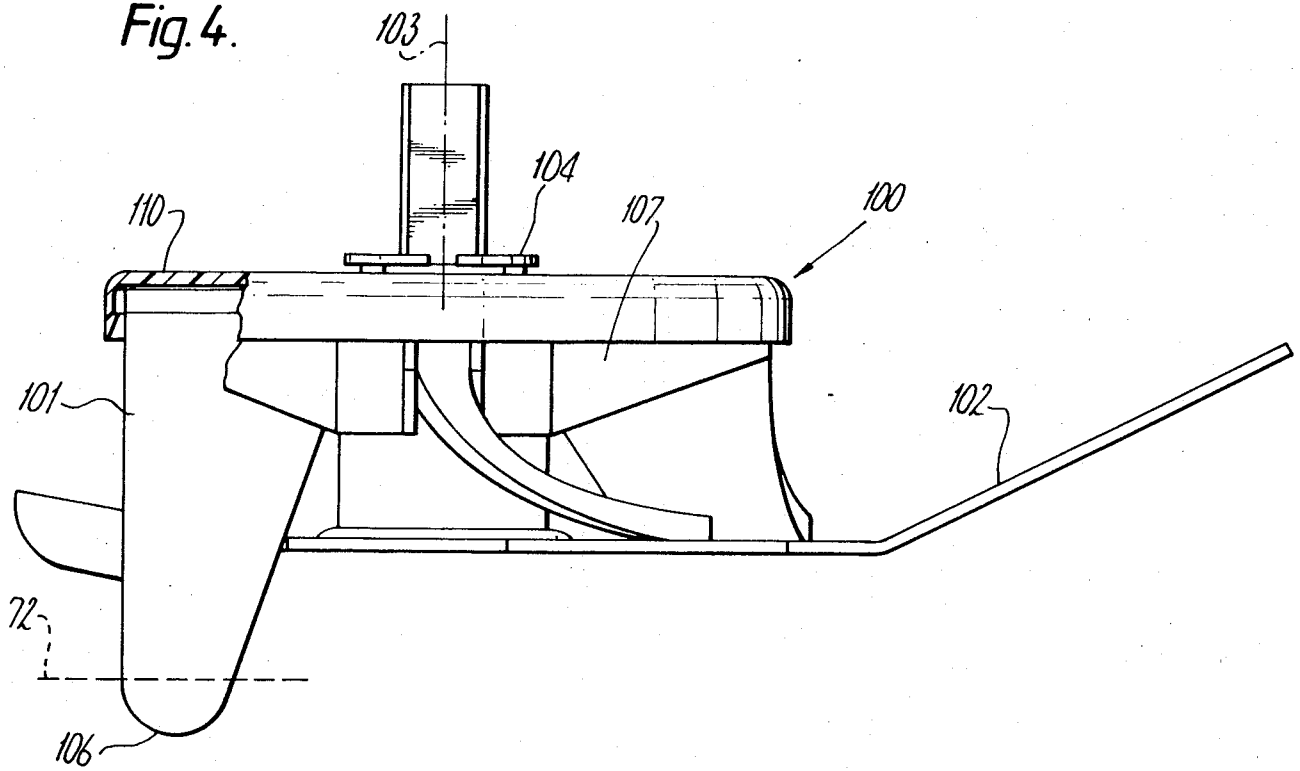
Figure 5:
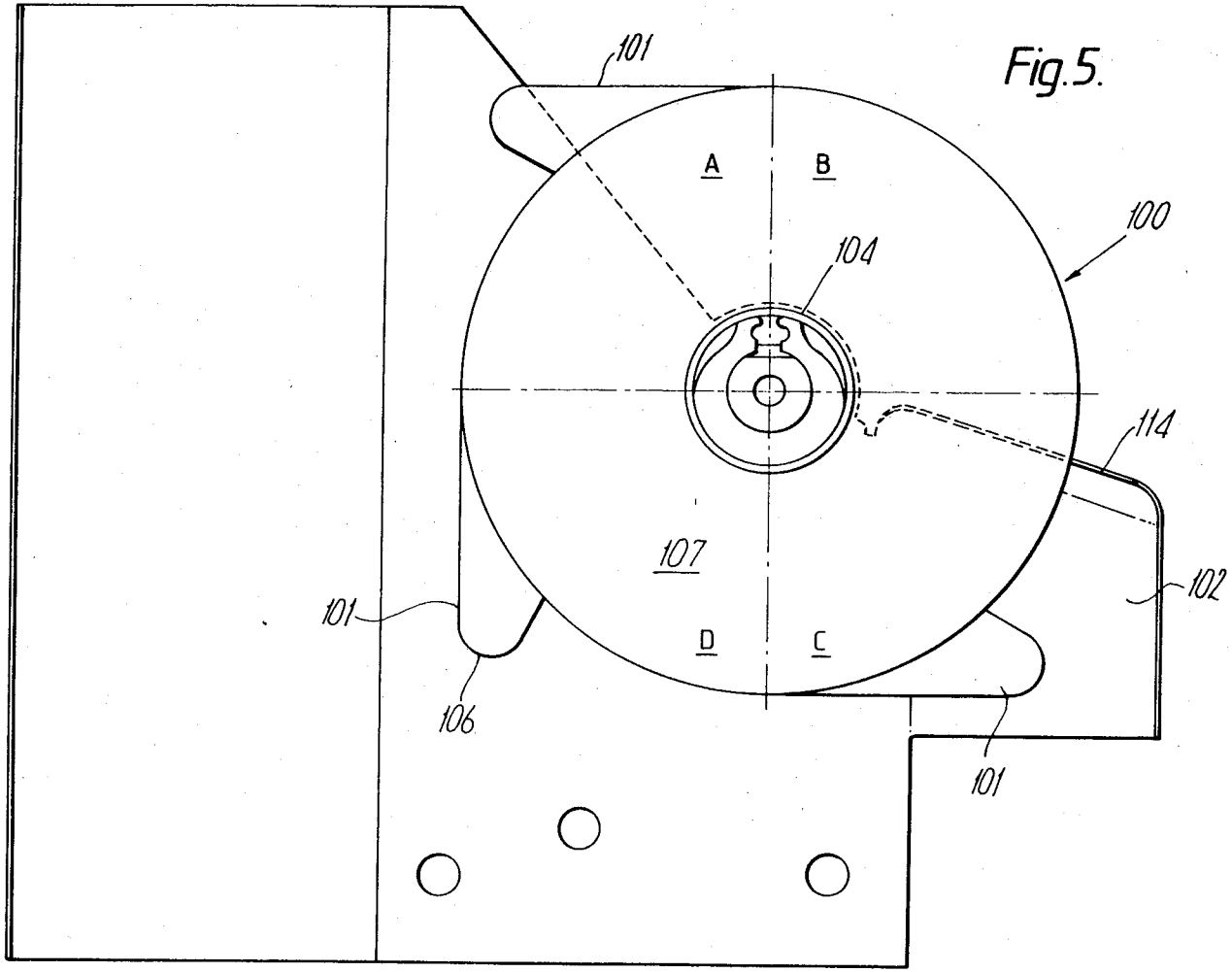
Figure 6:
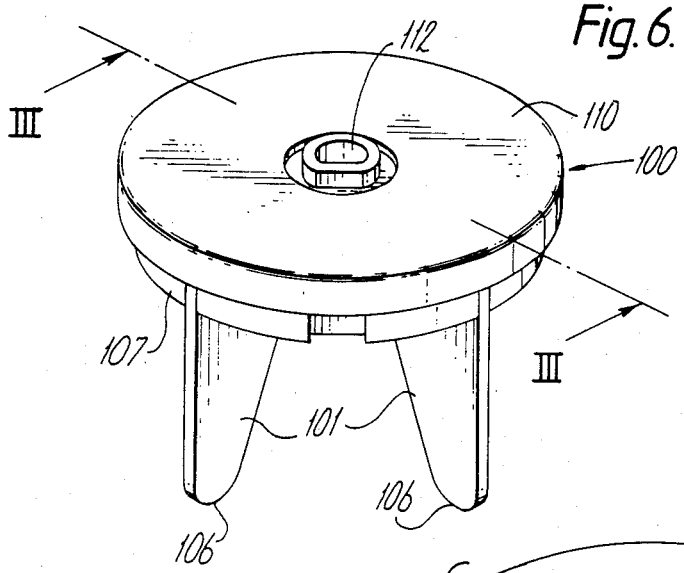
Figure 7:
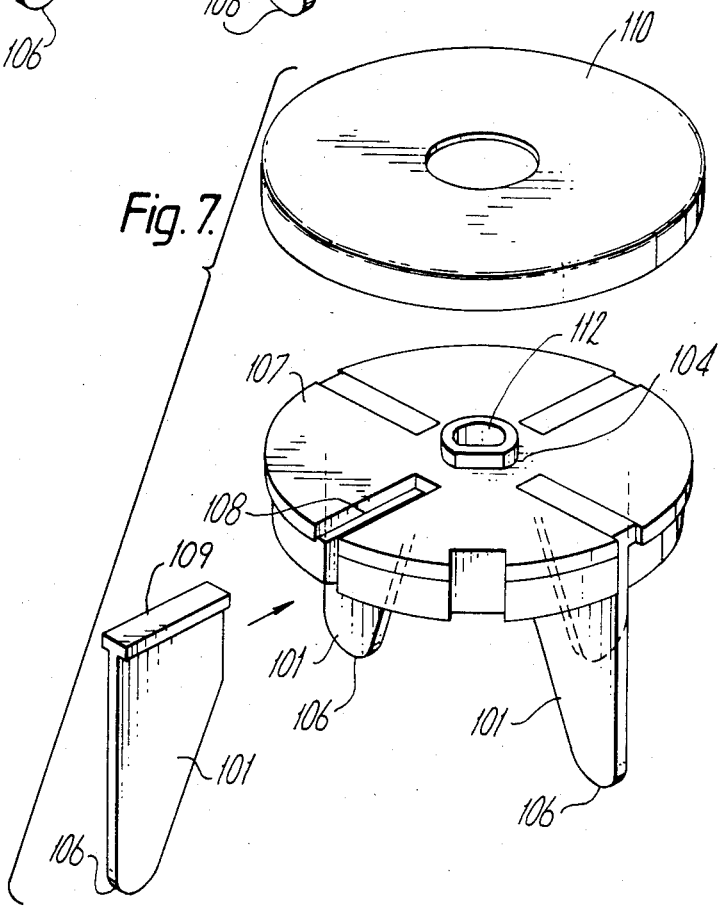
Figure 8:
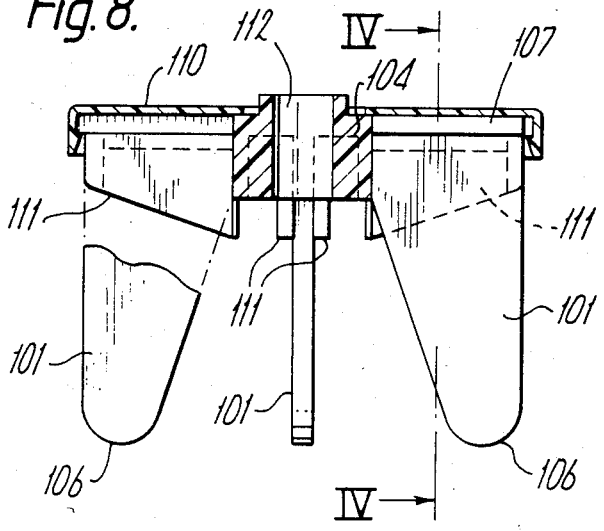
Figure 9:
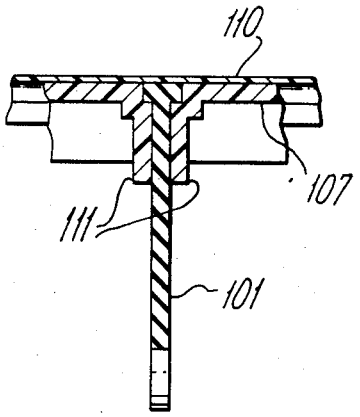

In order that the invention may be more readily understood, reference will now be made the accompanying drawings, in which:

FIG. 1 is a schematic side elevation of a photocopier including a finisher incorporating sheet registration apparatus according to the invention, FIG. 2 is a perspective view of the finisher of FIG. 1, partly exploded and with parts removed for clarity, on an enlarged scale, FIG. 3 is a section through the finisher along the direction of sheet travel looking towards the registration apparatus of this invention, showing the drive to the latter, FIG. 4 is an enlarged side elevation of the sheet registration apparatus, FIG. 5 is an enlarged plan view of the sheet registration apparatus, FIG. 6 is a perspective view of the registration device of the apparatus, FIG. 7 is an exploded perspective view of the device showing its construction, FIG. 8 is a section along the line III—III of FIG. 6, FIG. 9 is a section along the line IV—IV of FIG. 8, and FIGS. 10A–10C are schematic illustrations of typical blade footprints for different stack heights.

Referring to FIG. 1 there is shown an automatic xerographic reproducing machine 10 having a finisher 70 incorporating the sheet registration apparatus according to this invention for aligning sheets as they are stacked in the finisher prior to being acted upon by a stitcher 99. The copying machine 10 is capable of producing either simplex or duplex copies in sets from a wide variety of originals which may be advanced in recirculating fashion by a recirculating document apparatus 12 described in U.S. Pat. No. 3,556,512. Although the present invention is particularly well suited for use in automatic xerography the apparatus generally designated 70 is equally well adapated for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produced a flowing light image on the drum at B. Cut sheets of paper are moved into the transfer station from sheet registering apparatus 34 in synchronous relation with the image on the drum surface. The copy sheet is stripped from the drum surface and directed to a fusing station F. Upon leaving the fuser the fixed copy sheet is passed through a curvilinear sheet guide system generally referred to as 49, incorporating advancing rollers 50 and 51. The advancing rollers forward the sheet through a linear sheet guide system 52 and to a second pair of advancing rolls 53 and 54. At this point, depending on whether simplex or duplex copies are desired, the simplex copy sheet is either forwarded directly to the finisher 70 via pinch rolls 61, 62 or, for recirculation for making duplex copies, into upper supply tray 55, by means of a movable sheet guide 56. Movable sheet guide 56 and associated advancing rolls are pre-positioned by appropriate machine logic to direct the individual sheets into the desired path.

The finisher 70 includes a tray 71 having a base or support surface 72 inclined downwardly in the direction of sheet travel towards a registration corner 73 defined by registration members 74, 75 along the lower edge and one side of the tray. Along the upper end of the support surface is arranged a pair of co-acting sheet feed rolls 64, 65 arranged to receive sheets fed along passage 63 by pinch rolls 61, 62. From the feed rolls 64, 65 a sheet is directed by top guide 78 into the tray 71. A corner registration apparatus 79 in accordance with the present invention is arranged over the surface 72 to urge the sheets into the registration corner to position them for receiving a stitch from the apparatus 99. The registration fence 74 comprises two fingers 74 spaced to locate A4 and similar size paper with a third finger 74' to assist in locating wider sheets. The fingers 74, 74' are rotatable about an axis **74*a* so that they may be retracted for rejection of bound sets SS into a collection tray 69 or other suitable collection device such as a stacker which may have an elevating mechanism to increase its capacity and may be operable to offset sets or stacks delivered thereto. Any suitable ejection system such as drive rollers may be employed. As shown in FIG. 2 a continuously rotating roller 80 projects through the base 72 of the tray and when a stack or set is to be ejected an idler roller 81 on a sprung arm 82 mounted on a rail 83 over the tray is pressed down against the top of the stack by a cam (not shown) simultaneously with retraction of the registration fingers 74, 74'. Such an eject system in which the roller 80 is a soft roller having a low coefficient of friction surface (of less than $0.5\mu$) and which is deformed when the roller 81 is pressed down on the stack so as to increase its area of contact with the set is described in detail in our copending patent application Ser. No. 511,039 filed concurrently herewith. Such an eject system has been found particularly effective in ejecting unbound sets without disturbing their integrity. The eject rollers 80, 81 feed the stack or set into the nips of input rollers 84, 85 (FIG. 2) leading into the collection tray 69**.

As shown in FIG. 2, wire buckle control fingers 86 are arranged to engage the top sheet of the stack adjacent to the two registration fingers 74. One of these is carried on the arm 82 and the other on a bracket 87.

Referring now to FIGS. 2 to 9, the corner registration apparatus 79 of this invention comprises a rotatably mounted registration device or wiper device 100 having four resilient blades 101 arranged to wipe against the sheets being registered over a limited arc of rotation defined by a swash plate 102. The wiper has a hub 104 which is mounted for rotation about an axis 103 normal to the stack support surface. It is driven by a motor 115 through a flexible drive 117 mounted on a bracket 116 at the side of the tray 71. The blades 101, which are made of a resilient elastomeric material, are attached in the hub 104 by a circular backing plate 107 integral with the hub. They lie in radial planes passing through the axis 103 and depend from the backing plate 107, in the direction of the axis 103, towards sheet-engaging tips 106. The wiper 100 is arranged over the stack support surface 72 so that the blades are in interference with the support surface and wipe against it. The swash plate 102 is arranged between the wiper 100 and the stack support surface 72, being spaced above and parallel to the latter, so that the blades 101 are held out of contact with the support surface by the swash plate except over limited arc of rotation defined by an arcuate opening 114 in the swash plate. The arcuate extent and position of this opening are chosen so that as the wiper 100 rotates the blades urge the sheets into corner registration.

As shown in FIGS. 6 to 9, the wiper 100 has the tips 106 of the blades 101 lying in a common plane normal to said axis 103. As noted above the blades 101 are attached to the hub 104 by the circular backing plate 107. As best seen in FIG. 7 the blades 101 are mounted in radial slots 108 in the backing plate and to this end have T-mounting flanges 109. The blades 101 are held in position in the slots 108 by a clip-on cover 110.

The outer edges of the blades are parallel to the axis 103 but the inner edges are angled outwardly from the axis in the direction towards the tips 106 giving the blades a tapered form. The blades are rooted between pairs of support flanges 111 of the backing plate and as best seen in FIG. 8 these flanges are angled so as to give the blades an effective outward tilt relative to the axis 103.

The hub is provided with a mounting hole 112 which is non-circular for mounting it on the drive shaft of flexible drive 117.

The wiper 100 is arranged over the support surface so that the blades make interference contact with the support surface and the swash plate 102 is arranged above the surface 72 sufficiently to accommodate a stack of the desired height.

The blades 101 of wiper 100 pass into engagement with the sheets being stacked over a limited arc of rotation defined by the opening 114, which urges the sheet in the direction towards the registration corner.

The blades 101 of the wiper 100 are prevented by the swash plate 102 from contacting the sheet being registered except when they are over the opening 114. During the remainder of each revolution the blades are bent out of sheet contact as shown in FIGS. 4 and 5 against the upper surface of the swash plate. It will thus be realised that as the wiper 100 rotates the blades 101 enter the opening 114 in turn and due to their resilience unbend so as to engage a sheet therebeneath. Following a limited arc of rotation in contact with the sheet they are then disengaged from the sheet by again being bent upwards as they reach the end of the opening.

In the embodiment illustrated the registration device is rotated clockwise as seen from above.

The arcuate extent and angular position of the opening 114 in the swash plate 102 will depend on a number of factors. For a proper understanding of this it should be realised that as the blades are released by the swash plate for engagement with the sheet as they enter the opening there is a finite delay before the tip of the blade contacts the sheet and during this time the device will have rotated through a finite distance. The arc of contact of each blade with a sheet beneath the swash plate will thus be less than that of the opening. The size and position of the opening 114 will depend on the number of blades 101 of the registration device, the speed of rotation of the registration device and the height of the swash plate 102 above the support surface 72. The speed of rotation of the wiper device 100 will itself depend on the velocity of the sheets being delivered beneath it. Generally it is preferred that only one blade of the device is in contact with the sheet being registered at one time. However in the case of a stacker it will be realised that as the stack builds up the blades will take less time to come into engagement with the sheets and depending particularly on the speed of rotation of the device and the capacity of the stacker it may be that a swash plate opening chosen to given a sufficient arc of contact with the bottom or first delivered sheet in the stack will result in the top sheets of a relatively thick stack being contacted momentarily by two blades. Generally, the contact of the blades with the sheet should preferably not be greater than a 90° arc extending between the direction of sheet travel and the direction normally towards the side registration edge. However by mounting the blades as in the embodiment illustrated so that they will be bent generally tangentially to the backing plate the arc may be extended slightly without the blade tips moving from the registration edge in opposition to sheet travel.

Figure 10A:
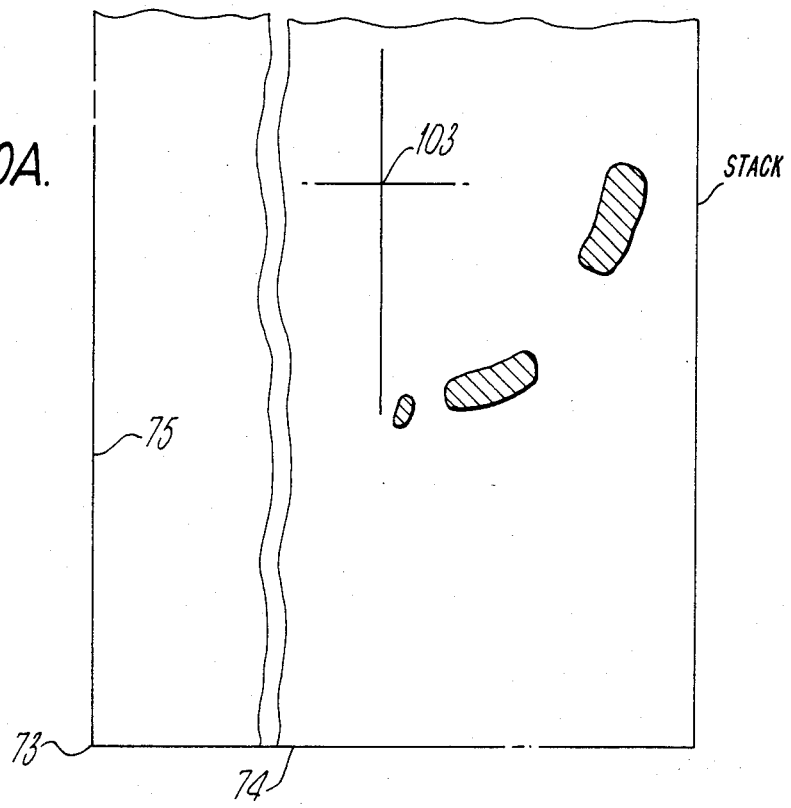
Figure 10B:
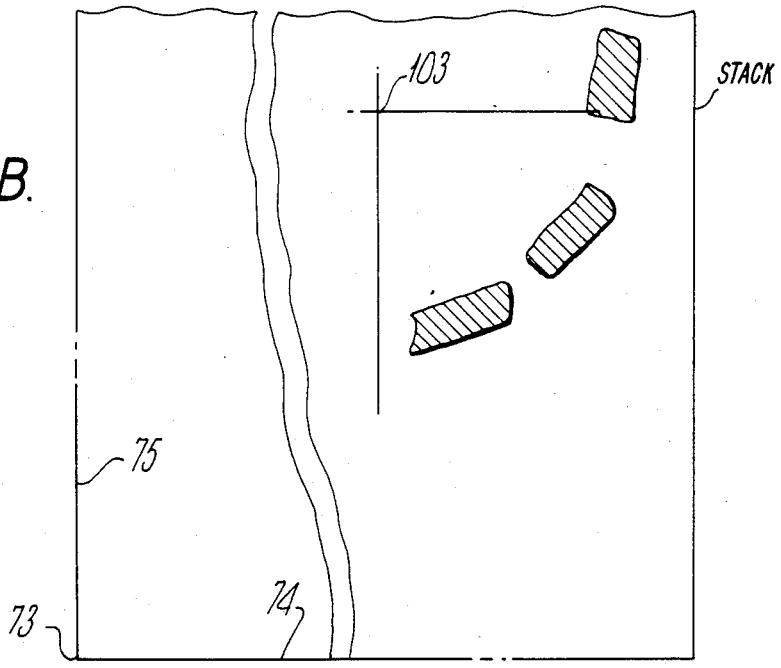
Figure 10C:
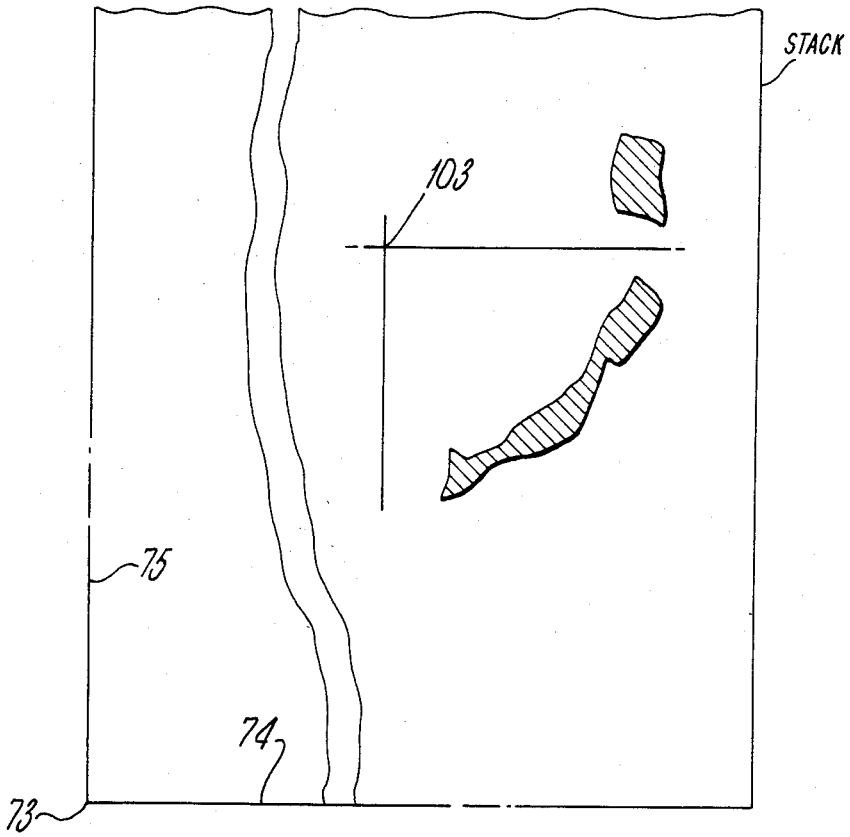

Three typical footprints of a blade with sheets at different heights above the support surface are shown in FIGS. 10A to 10C in which FIG. 10A shows the footprint for a minimum stack height, FIG. 10C shows the footprint for a maximum stack height and FIG. 10B shows the footprint for an intermediate stack height. It should be noted that contact with the sheet is not continuous but rather increases in extent with increase in set height. This is not surprising since the vertical travel of the blade tip and thus its tendency to bounce is less the higher is the stack. It will also be seen that the higher the stack the earlier the blade both contacts and disengages from the sheet.

It would perhaps be expected that since reverse wiping of the blades, i.e. in opposition to the direction of sheet travel, should be avoided, the exit end of the swash plate opening 114 should be parallel to the side registration edge. However because there is an interference between the blade tip 106 and the stack support surface 72 (which interference increases as a stack is built up), the exit end of the swash plate opening 114 may be positioned slightly beyond the radius of the registration device which is parallel to the side registration edge so that the blade does complete a 90° arc of wiping movement with the tip travelling normally to the registration edge at the time it is lifted off the surface of the sheet.

Depending upon the sheet velocity, stack height requirements (which determine the height of the swash plate above the support surface) and the dimensions of the registration device, the swash plate opening 114 may vary from less than 90° up to 150° or more. In order to avoid the blade tip 106 passing the radius of the device 100 parallel to the side registration edge, the angle between that radius and the end of the opening 114 will not be more than a few degrees and will be proportional to the minimum interference of the blade tips with the stack support surface. Desirably, the angle will be such that for a single sheet on the stack support surface the blade tip is disengaged from the sheet at the moment when it is travelling normally to the side registration edge. Given that as the stack height increases, so does the interference of the blade with the stack the time at which the blade will be disengaged is advanced. For side registration it is desirable that the blade wipe nearly as possible up to the direction normal to the registration edges so the angle of the exit of the opening 114 is chosen to give this condition for a single sheet.

The angular position of the entry edge of the opening 114 will depend upon the degree of forward motion to be imparted to the sheet, the velocity of the sheet itself and, importantly, the speed of rotation of the registration device. The limit position is that in which the blade when it first contacts the sheet is travelling parallel to the registration edge. This will depend upon the height of the swash plate, the manner in which the blade bends when it contacts the sheet and the amount of interference between the blade and the swash plate, as well as the distance of the stack below the swash plate. Further the more resilient the blade material the quicker it will engage the sheet when it is released from the swash plate.

As has been mentioned it is preferable to avoid contact with the sheet by two blades simultaneously. Thus the size of the opening will also depend upon the number and angular spacing of the blades. It has been found that for a device having five blades an opening of slightly more than 90° is suitable whereas for a device having four blades an angle of 146° has been found satisfactory.

In a specific embodiment the device has four blades equally spaced therearound and mounted in a rigid plastic backing plate 107 so as to depend from the plate at an effective outwardly projecting angle relative to the axis 103 of 20°. The blades are made of millable polyurethane rubber such as that sold as WMS1008 available from Woodville Polymer Engineering Limited of Ross-on-Wye, Herefordshire, England and are 39 mm long measured from their effective roots (where they project out of the backing plate) to their tips 106. The blade tips 106 are 32 mm from the axis 103 and the blades are 3 mm thick and 24 mm wide at their roots. The swash plate top surface is 15.6 mm above the stack support surface and the blade has an interference of 5 mm with the support surface (and thus 20.6 mm with the top of the swash plate). The arcuate opening 114 in the swash plate is 146° with the entry edge of the opening positioned at an angle of 39° ahead of that radius of the device which is normal to the side registration edge. Such apparatus would be suitable for up to about 12 to 13 mm stacks of flat paper but where, as in practice, sheets exiting a photocopier exhibit some degree of curl, the swash plate height designated is intended for stacks up to about 7.5 mm.

In order to keep friction to a minimum the top surface of the swash plate 102 is coated with a low-friction material such as a fluoro-carbon (PTFE) resin.

The speed of rotation of the wiper device 100 is designed to be such that the tips of the blades 101 should have a velocity greater than the forward motion of the sheets being registered. Further it must be fast enough to register a sheet before the arrival beneath the swash plate of the next sheet and desirably fast enough to register the last sheet in time to permit binding (stitching) in the intersheet gap period. Thus for sheets travelling at an input speed of 973 mm per sec., a blade tip speed of greater than 1800 mm per sec. has been found desirable. For this speed a four bladed registration device will rotate at 478 rpm giving a frequency of blade to sheet contact of 40 per sec.

The friction between the blades 101 and the sheet being registered needs to be greater than the intersheet friction. The intercopy or intersheet friction is generally of the order 0.15 to 0.65$\mu$ and the blade/sheet friction is desirably between 0.8 and 2.0$\mu$, preferably 1.4$\mu$.

The registration apparatus 79 is desirably positioned as close as possible to the registration edges. In practice the position is limited by the stitcher head or other binding device and in the embodiment shown the axis of the registration device is 45 mm from the side registration edge 75 and 85 mm from the front registration edge 74.

In order to prevent wander of the bottom sheet in a stack, friction pads 119 comprising bristles pointing towards the side registration edge 75 are provided on the stack support surface.

While a particular embodiment of the invention has been described it will be understood that various modifications may be made to the specific details referred to herein without departing from the scope of the invention as defined in the appended claims. For example while the blades of the registration device illustrated are driven clockwise when the device is seen in plan with the blades contacting the sheets generally in the quadrant B seen in FIG. 5 the device can be rotated anticlockwise with the opening 114 arranged generally in the quadrant D of FIG. 5.

While the apparatus illustrated shows sheets being registered in a stack it is to be understood that the registration apparatus of this invention is equally applicable to registering sheets against a side registration edge only in which the sheets continue in their forward movement and are not limited by an end registration stop. For example in the apparatus illustrated, the registration fence 74 may be retracted and sheets side registered and fed directly into the collection device 69. This would be particularly applicable where the collection device is a sheet stacker, especially one which has offset stacking facilities. Apparatus 79 ensures that the sheets entering the stacker are properly aligned.

In a modification the registration device is formed as a one-piece moulding of resilient elastomeric material.

I claim:

1. A sheet registration apparatus for registering a sheet on a surface against a registration stop, comprising a device having a plurality of resilient blades lying in radial planes passing through an axis arranged generally normal to the surface and about which said blades are rotatable with said blades extending in the direction of said axis towards said surface and terminating in sheet engaging tips arranged to wipe over a limited arc of rotation against a sheet on the surface to urge it towards said registration stop.

2. A sheet registration apparatus according to claim 1 in which the blades are arranged to contact a sheet on the surface over a limited arc of rotation to urge the sheet towards the registration stop.

3. A sheet registration apparatus according to claim 2 including a swash plate arranged beneath the blades and above and generally parallel to the surface and having an arcuate opening defining the arc of contact.

4. A sheet registration apparatus according to claim 3 in which said axis is normal to said surface.

5. A sheet registration apparatus according to claim 3 in which the opening in the swash plate extends through an angle between 90 and 150 degrees.

6. A sheet registration apparatus according to claim 3 in which said blades taper towards their tips.

7. A sheet registration apparatus according to claim 3 in which the tips of said blades are rounded.

8. A sheet registration apparatus according to claim 1 in which the blades are made of resilient elastomeric material, for example polyurethane rubber.

9. A sheet registration apparatus according to claim 1 in which there are four blades arranged symmetrically about said axis.

10. A sheet registration apparatus according to claim 1 in which the blades are tilted outwardly from the axis of the device, e.g. by 20 degrees.

11. A sheet registration device including a hub having an axis of rotation and a plurality of resilient plastic blades arranged in radial planes passing through said axis and extending in the direction of said axis beyond one end of the hub towards sheet-engaging tips lying in a common plane normal to said axis.

12. A sheet registration device according to claim 11 in which the blades are attached to said hub by their axial ends opposite the tips.

13. A sheet registration device according to claim 11 in which the hub and blades are formed as a one-piece plastics moulding.

14. A sheet registration device according to claim 11 in which the blades are made of resilient elastomeric material, for example, polyurethane rubber.

15. A sheet registration device according to claim 11 in which said blades taper toward said tips.

16. A sheet registration device according to claim 11 in which said tips are rounded.

17. A sheet registration device according to claim 11 in which there are four blades symmetrically arranged about said axis.

18. A sheet registration device according to claim 11 in which said blades are filled outwardly from said axis or rotations, e.g. by 20 degrees.

* * * * *